US007931800B2

(12) United States Patent
Ozum

(10) Patent No.: US 7,931,800 B2
(45) Date of Patent: Apr. 26, 2011

(54) METHOD FOR EXTRACTION OF BITUMEN FROM OIL SANDS USING LIME

(75) Inventor: Baki Ozum, Edmonton (CA)

(73) Assignee: Apex Engineering Inc., Edmonton (CA)

( * ) Notice: Subject to any disclaimer, the term of this patent is extended or adjusted under 35 U.S.C. 154(b) by 206 days.

(21) Appl. No.: 12/048,430

(22) Filed: Mar. 14, 2008

(65) Prior Publication Data

US 2008/0223757 A1 Sep. 18, 2008

Related U.S. Application Data

(60) Provisional application No. 60/894,827, filed on Mar. 14, 2007.

(51) Int. Cl.
*C10G 1/04* (2006.01)

(52) U.S. Cl. ..... 208/390; 208/391

(58) Field of Classification Search ..... 208/390, 208/391

See application file for complete search history.

(56) References Cited

U.S. PATENT DOCUMENTS

| | | | | |
|---|---|---|---|---|
| 3,542,666 | A | 11/1970 | Simpson | |
| 3,900,389 | A * | 8/1975 | Baillie | 208/390 |
| 4,174,263 | A * | 11/1979 | Veatch et al. | 208/390 |
| 4,392,949 | A | 7/1983 | Kruyer | |
| 5,316,664 | A * | 5/1994 | Gregoli et al. | 208/391 |
| 6,576,145 | B2 | 6/2003 | Conaway et al. | |

FOREIGN PATENT DOCUMENTS

| | | |
|---|---|---|
| CA | 1291957 | 11/1991 |
| CA | 2188064 | 4/1998 |
| CA | 2522031 | 4/2006 |
| WO | WO2006060917 | 6/2006 |

* cited by examiner

*Primary Examiner* — Glenn A Caldarola
*Assistant Examiner* — Michelle L Stein
(74) *Attorney, Agent, or Firm* — Donald V. Tomkins

(57) ABSTRACT

In a method for enhancing the efficiency of bitumen recovery from oil sands ore, CaO lime (or $Ca(OH)_2$) is mixed into an oil sands ore-water slurry prior to or during the operation of slurry-based bitumen extraction processes. The lime is introduced at dosages effective to reduce the electro-chemical attraction between clay particles and bitumen in the slurry, thereby promoting detachment of clay particles from bitumen droplets in the ore-wafer slurry. This occurs because water-soluble asphaltic acids formed at the bitumen-water interface act as surfactants which reduce or eliminate the activity of $Ca^{2+}$ and $Mg^{2+}$ ions binding the clay particles and bitumen together. The detachment of clay particles promotes the attachment of air bubbles to the bitumen droplets, thereby forming a bitumen-rich froth which will float to the surface of the ore-water slurry, thus facilitating bitumen recovery.

12 Claims, 4 Drawing Sheets

Oil sands ore properties used in extraction tests

| **Dean-Stark** | **Mass Fraction (%)** |
|---|---|
| Bitumen (ore basis) | 9.8 |
| Solids (ore basis) | 85.1 |
| Moisture (ore basis *) | 3.4 |
| **Proximate** | |
| Sands (ore basis) | 73.0 |
| Fines (ore basis) | 12.1 |
| Fines (solids basis, % f) | 14.2 |
| Moisture (by drying, ore basis**) | 4.6 |

(*) gives material balance of 98.3 %
(**) gives material balance of 99.5 %

FIG. 1

Release water chemistry after large-scale extraction cycles

| Recycled Water | *CaO* | | *Conduct.* | Alkalinity (mg *CaCO3/L*) | | | Cations (mg/L) | | | Anions (mg/L) | |
|---|---|---|---|---|---|---|---|---|---|---|---|
| Sample ID | mg/kg Ore | *pH* | *(mS)* | Total | $CO_3$ | $HCO_3$ | $Na^+$ | $Mg^{2+}$ | $Ca^{2+}$ | $Cl$ | $SO_4^=$ |
| Lock Cycle-Run 1 | 150 | 8.2 | 1.492 | 307 | 0 | 307 | 441 | 8 | 8 | 171 | 158 |
| Lock Cycle-Run 2 | 150 | 8.1 | 1.462 | 225 | 0 | 225 | 373 | 9 | 10 | 177 | 220 |
| Lock Cycle-Run 2A | 150 | 7.9 | 1.527 | 230 | 0 | 230 | 401 | 9 | 10 | 174 | 213 |
| Lock Cycle-Run 3 | 150 | 7.7 | 1.479 | 176 | 0 | 176 | 354 | 9 | 12 | 180 | 254 |
| Lock Cycle-Run 4 | 150 | 7.4 | 1.516 | 155 | 0 | 155 | 352 | 12 | 15 | 187 | 277 |
| Lock Cycle-Run 5 | 150 | 7.5 | 1.53 | 137 | 0 | 137 | 358 | 13 | 15 | 187 | 293 |

FIG. 2

**Results of bitumen extraction tests performed at 50° C process temperature (*)**

| Test Conditions | Froth Yield (g) | Bitumen Yield (g) | Bitumen Recovery (%) | Bitumen in Froth (%) | Water in Froth (%) | Solids in Froth (%) |
|---|---|---|---|---|---|---|
| Lock Cycle-Run 1 | | | | | | |
| Blank | 125.42 | 27.05 | 92.3 | 21.6 | 34.1 | 45.4 |
| *CaO* 60 mg/kg ore | 128.71 | 27.78 | 94.8 | 21.6 | 34.9 | 42.7 |
| *CaO* 60 mg/kg ore | 131.47 | 28.27 | 96.4 | 21.5 | 35.0 | 41.7 |
| Lock Cycle-Run 2 | | | | | | |
| Blank | 142.77 | 26.57 | 92.7 | 18.6 | 30.3 | 46.5 |
| *CaO* 60 mg/kg ore | 138.51 | 28.33 | 96.7 | 20.5 | 33.9 | 44.3 |
| *CaO* 60 mg/kg ore | 149.65 | 27.84 | 95.2 | 18.6 | 34.7 | 45.6 |
| Lock Cycle-Run 3 | | | | | | |
| Blank | 138.96 | 28.28 | 96.5 | 20.3 | 33.5 | 45.1 |
| *CaO* 60 mg/kg ore | 142.99 | 27.28 | 93.1 | 19.1 | 34.5 | 44.9 |
| *CaO* 60 mg/kg ore | 151.1 | 29.23 | 99.7 | 19.3 | 32.9 | 46.4 |
| Lock Cycle-Run 4 | | | | | | |
| Blank | 143.21 | 27.08 | 92.9 | 18.9 | 35.7 | 45.2 |
| *CaO* 60 mg/kg ore | 135.05 | 28.2 | 96.2 | 20.9 | 34.0 | 44.0 |
| *CaO* 60 mg/kg ore | 128.11 | 27.34 | 93.3 | 21.3 | 35.9 | 41.0 |
| Lock Cycle-Run 5 | | | | | | |
| Blank | 138.21 | 27.8 | 94.8 | 20.1 | 34.4 | 43.6 |
| *CaO* 60 mg/kg ore | 143.07 | 28.12 | 95.9 | 19.7 | 31.7 | 47.5 |
| *CaO* 60 mg/kg ore | 144.32 | 27.84 | 95.0 | 19.3 | 33.7 | 45.9 |

(*) Properties of oil sands ore used in these tests are presented in Fig. 1.

FIG. 3

**Release water chemistry for bitumen extraction tests performed at 50° C process temperature (*)**

| Sample | CaO | Conductivity | | Alkalinity (mg CaCO3/L) | | | Cations | | | Anions | |
|---|---|---|---|---|---|---|---|---|---|---|---|
| ID | mg/kg Ore | pH | (mS) | Total | CO3 | HCO3 | Na | Mg | Ca | Cl | SO4 |
| Lock Cycle-Run 1 | | 8.2 | 1.492 | 307 | 0 | 307 | 441 | 8 | 8 | 171 | 158 |
| Sh0107-12 | Blank | 8.3 | 1.372 | 230 | 0 | 230 | 340 | 9 | 8 | 165 | 174 |
| Sh0107-13 | 60 | 8.5 | 1.412 | 233 | 6 | 227 | 338 | 10 | 10 | 174 | 184 |
| Sh0107-14 | 60 | 8.5 | 1.440 | 247 | 6 | 241 | 338 | 10 | 10 | 176 | 185 |
| Lock Cycle-Run 2 | | 8.1 | 1.462 | 225 | 0 | 225 | 373 | 9 | 10 | 177 | 220 |
| Sh0107-15 | Blank | 7.7 | 1.319 | 156 | 0 | 156 | 308 | 10 | 9 | 164 | 218 |
| Sh0107-16 | 60 | 7.8 | 1.393 | 169 | 0 | 169 | 322 | 12 | 13 | 174 | 231 |
| Sh0107-17 | 60 | 7.9 | 1.388 | 170 | 0 | 170 | 326 | 12 | 13 | 172 | 229 |
| Lock Cycle-Run 2A | | 7.9 | 1.527 | 230 | 0 | 230 | 401 | 9 | 10 | 174 | 213 |
| Sh0107-37 | Blank | 7.8 | 1.406 | 152 | 0 | 152 | 300 | 12 | 11 | 175 | 243 |
| Sh0107-38 | 60 | 7.9 | 1.479 | 171 | 0 | 171 | 335 | 13 | 13 | 176 | 250 |
| Sh0107-39 | 60 | 7.9 | 1.474 | 171 | 0 | 171 | 312 | 13 | 13 | 181 | 252 |
| Lock Cycle-Run 3 | | 7.7 | 1.479 | 176 | 0 | 176 | 354 | 9 | 12 | 180 | 254 |
| Sh0107-40 | Blank | 7.8 | 1.404 | 115 | 0 | 115 | 297 | 13 | 12 | 176 | 275 |
| Sh0107-41 | 60 | 8.1 | 1.484 | 133 | 0 | 133 | 310 | 14 | 15 | 184 | 290 |
| Sh0107-42 | 60 | 8.0 | 1.487 | 136 | 0 | 136 | 314 | 14 | 15 | 184 | 289 |
| Lock Cycle-Run 4 | | 7.4 | 1.516 | 155 | 0 | 155 | 352 | 12 | 15 | 187 | 277 |
| Sh0107-43 | Blank | 7.9 | 1.516 | 103 | 0 | 103 | 313 | 16 | 15 | 192 | 321 |
| Sh0107-44 | 60 | 8.1 | 1.523 | 118 | 0 | 118 | 334 | 16 | 14 | 184 | 311 |
| Sh0107-45 | 60 | 8.1 | 1.525 | 119 | 0 | 119 | 309 | 17 | 17 | 191 | 320 |
| Lock Cycle-Run 5 | | 7.5 | 1.530 | 137 | 0 | 137 | 358 | 13 | 15 | 187 | 293 |
| Sh0107-46 | Blank | 7.8 | 1.533 | 93 | 0 | 93 | 316 | 18 | 15 | 196 | 343 |
| Sh0107-47 | 60 | 7.8 | 1.544 | 109 | 0 | 109 | 303 | 19 | 18 | 195 | 339 |
| Sh0107-48 | 60 | 7.8 | 1.529 | 111 | 0 | 111 | 330 | 18 | 18 | 187 | 324 |

(*) Properties of oil sands ore used in these tests are presented in Fig. 1.

FIG. 4

METHOD FOR EXTRACTION OF BITUMEN FROM OIL SANDS USING LIME

CROSS-REFERENCE TO RELATED APPLICATIONS

This application claims the benefit, pursuant to 35 U.S.C. 119(e), of U.S. Provisional Application No. 60/894,827, filed on Mar. 14, 2007, and said provisional application is incorporated herein by reference in its entirety.

FIELD OF THE INVENTION

The present invention relates to processes for extracting bitumen from oil sands.

BACKGROUND OF THE INVENTION

The oil sands deposits of northern Alberta in Canada contain about 142 billion cubic meters (or 890 billion barrels) of bitumen, thus constituting the largest oil sands deposit in the world. In the Athabasca region of Alberta, the oil sands deposits are typically composed of (by weight) about 12% bitumen, 82% to 85% mineral matter (solids), and 3% to 6% water. Of the solids fraction, the solids smaller than 45 microns in size (i.e., silt and clay) are referred to as fines. The clay fraction of the fines can be a significant factor in processes for both extraction of bitumen and disposal of oil sands tailings (i.e., residue from primary oil sands processing).

The bitumen content of the Athabasca deposits has been commercially utilized by oil sands ore-water slurry-based extraction processes and thermal in-situ processes, and upgraded to synthetic crude oil at a production capacity of over one million barrels per day. In the major bitumen recovery operations in the Athabasca region, bitumen is produced from surface-mineable oil sands using water-slurry-based extraction processes, in which the oil sands "ore" (i.e., the raw oil sands material, as excavated from the oil sands deposits) is mixed with hot water to form an ore-water slurry. Asphaltic acids present in bitumen, which contain partly aromatic oxygen functional groups such as phenolic, carboxylic and sulphonic types, become water-soluble, especially when the ore-water slurry's pH (i.e., a measure of acidity expressed as the minus logarithm of the hydrogen ions concentration: $pH=-\log [H^+]$) is slightly over 7, and act as surfactants reducing surface and interfacial tensions. Reduction of the surface and interfacial tensions of the ore-water slurry system results in the disintegration of the ore structure and liberation of bitumen from the ore. Accordingly, the water-soluble fraction of bitumen asphaltenes plays an important role in the recovery of bitumen from the surface-mineable oil sands ore.

It is known that the water-soluble fraction of bitumen is increased by an increase in the pH of an oil sands ore-water slurry by the addition of caustic soda (NaOH), soda ash ($Na_2CO_3$), or any salt of weak acid and strong base (hydrolysis of which would be basic). Alternatively, this desirable result can be achieved by modifying the asphaltene molecules contained in bitumen by oxidation, sulfonation, and/or sulfoxidation reactions to form water soluble surfactants, which reduce the surface and interfacial tensions: see International Application No. PCT/CA2005/001875 (WIPO Pub. No. WO 2006/060917).

Liberated bitumen has to be recovered from the ore-water slurry by separation methods based on density differences. Bitumen density is very close to the density of water; consequently, bitumen needs to become effectively "attached" to air bubbles in order for it to be recovered from the ore-water slurry system by means of flotation. However, clay particles present in the ore can become attached to bitumen droplets, thus preventing the desired interaction between bitumen droplets and air bubbles. This undesirable attachment of clay particles to bitumen is promoted by calcium ($Ca^{2+}$) and magnesium ($Mg^{2+}$) ions present in the process water. Another significant factor with respect to bitumen recovery is that the temperature of the ore-water slurry has to be above a critical temperature, above which bitumen becomes mobile enough (i.e., has sufficiently low viscosity) to enfold air bubbles and thus facilitate flotation. This critical temperature for Athabasca bitumen is reported by several researchers to be around 32° C.

In summary, liberation of bitumen from the oil sands matrix and attachment of air bubbles to the liberated bitumen are essential process steps for bitumen recovery in ore-water slurry-based extraction processes.

BRIEF SUMMARY OF THE INVENTION

In general terms, the present invention is a non-caustic bitumen extraction process (i.e., a process that does nor use caustic NaOH as an additive), which relates to bitumen recovery in oil sands ore-water slurry-based extraction processes using lime (CaO or $Ca(OH_2)$ as a process additive. The addition of CaO (or $Ca(OH)_2$) lime, in effective dosages, into ore-water slurry has been found to promote the liberation of bitumen from the oil sands matrix, to promote detachment of clay particles from bitumen droplets, and to improve or promote the attachment of bitumen to air bubbles, thus increasing bitumen recovery efficiencies. The methods of the present invention also improve the chemistry of the release water (release water being defined as residual water from slurry-based bitumen extraction processes), and reduce the clay content in the release water by flocculating the clay particles present therein by $Ca^{2+}$ introduced into the slurry by the addition of CaO (i.e., $Ca(OH)_2$), thus enhancing the release water's suitability for recycling to the extraction process. The methods of the present invention are effective over a wide range of process temperatures, specifically including (but not limited to) the range of 25° C. to 85° C.

BRIEF DESCRIPTION OF THE DRAWINGS

Embodiments of the invention will now be described with reference to the accompanying figures, in which:

FIG. 1 is a table of compositional properties of oil sands ore used in bitumen extraction tests described herein.

FIG. 2 is a table showing release water chemistry after multiple, bitumen extraction tests performed with addition of 150 mg CaO per kg of oil sands ore per test cycle.

FIG. 3 is a table showing results of bitumen extraction tests performed with addition of 60 mg CaO per kg of oil sands ore per test cycle.

FIG. 4 is a table showing release water chemistry after multiple bitumen extraction tests performed with addition of 60 mg CaO per kg of oil sands ore per test cycle.

DETAILED DESCRIPTION OF THE INVENTION

The methods of present invention use CaO lime (or $Ca(OH)_2$) at dosages effective to reduce the attraction between clay particles and bitumen, thereby promoting the detachment of clay particles from bitumen droplets in an oil sands ore-water slurry. The effective dosage of CaO (i.e., $Ca(OH)_2$) addition is the dosage which increases the pH of the oil sands ore-water slurry to about 8 to 9 and provides sufficient $Ca^{2+}$ ions to promote flocculation of clay particles attached to bitumen droplets in the slurry by the ion-exchange reaction: $2Clay-Na+Ca(OH)_2 \leftrightarrow (Clay)_2-Ca+2NaOH$). The addition of CaO lime into the ore-water slurry causes the pH of the slurry to increase, thus enhancing the water-solubility of asphaltic acids contained in the bitumen. Water-soluble asphaltic acids formed at the bitumen-water interface act as surfactants and reduce or eliminate the activity of $Ca^{2+}$ and $Mg^{2+}$ ions binding the clay particles and bitumen together.

When CaO lime (or $Ca(OH)_2$) is added to the ore-water slurry, the alkali action (i.e., increased pH due to the introduction of OH ions) results in an increase in the solubility of asphaltic acids (fraction of bitumen asphaltenes), and clay particles in the slurry react with the $Ca^{2+}$ and $Mg^{2+}$ ions. This results in detachment of clay particles from bitumen droplets, and promotes the attachment of bitumen droplets to air bubbles, which in turn promotes bitumen extraction efficiency for reasons previously discussed.

The clay particles detached from the bitumen droplets flocculate within the slurry mixture by ion exchange reactions (i.e., $2Clay-Na+Ca^{2+} \leftrightarrow (Clay)_2-Ca+2Na^+$; or, more specifically, $2Clay-Na+Ca(OH)_2 \leftrightarrow (Clay)_2-Ca+2NaOH$) between the clay and the $Ca^{2+}$ ions introduced by CaO addition and/or the $Ca^{2+}$ and $Mg^{2+}$ ions attached to water-soluble asphaltic acids produced by CaO addition. Experimental findings have indicated that release water recovered from ore-water slurry conditioned with CaO lime has lower turbidity (a measure for the amount of suspended clay size particles in the water). In fact, addition of CaO lime even at very low dosages introduces additional $Ca^{2+}$ ions for the clay particle to flocculate, which converts $Ca(OH)_2$ to NaOH (by the ion exchange reaction: $2Clay-Na+Ca(OH)_2 \leftrightarrow (Clay)_2Ca+2NaOH$) during the extraction process. Release water chemistry results indicating low $Ca^{2+}$ and $Mg^{2+}$ concentrations provide evidence that such ion exchange reactions are occurring in addition to chemical reactions forming carbonates ($CaCO_3$ or $MgCO_3$) from bicarbonates (i.e., by the reaction: $Ca,Mg(HCO_3)_2+Ca(OH)_2 \leftrightarrow 2Ca,MgCO_3+2H_2O$). As an example, when CaO is added at a dosage of 150 mg/kg ore into an oil sands ore-water slurry having a composition of ore/water mass ratio of 5/6, bitumen extraction efficiency increases. However, $Ca^{2+}$ and $Mg^{2+}$ concentrations in the release water are at about 10 mg/L (milligram per liter). Notably, the $Na^+$ ion concentration in the release water does not increase; the use of CaO as a process aid reduces or eliminates the accumulation of $Na^+$ in the release water.

Furthermore, carbon dioxide ($CO_2$) contained in the atmosphere will also react with $Ca(OH)_2$ lime added into an ore-water slurry, resulting in the precipitation of calcium carbonate ($CaCO_3$) by the reaction: $Ca(OH)_2+CO_2 \leftrightarrow CaCO_3+H_2O$. As a result of this reaction, the pH of the slurry and/or release water would be reduced as functions of time and temperature, to the range of approximately 8.0 (or even lower), which would be suitable for recycling of the release water for re-use in the extraction process.

Laboratory tests have demonstrated that the methods of present invention, using CaO lime (or $Ca(OH)_2$) as a bitumen extraction process aid at dosages in the range of 50 to 150 mg/kg ore, can promote bitumen extraction efficiency without harming the release water chemistry, because of the above-noted chemical reactions taking place simultaneously. The process water used for the preparation of oil sands ore-water slurry for the laboratory tests had the following chemistry: pH=8.18, Total Alkalinity (mg $CaCO_3$/L)=307, $HCO_3$ Alkalinity (mg $CaCO_3$/L)=307, $Na^+$=441 mg/L, $Mg^{2+}$=7.8 mg/L, $Ca^{2+}$=7.6 mg/L, Cl=171 mg/L, and $SO_4^{2-}$=158 mg/L.

Extraction tests were performed using a Denver D-12 flotation cell apparatus, at 50° C. temperature, using ore-water slurry composed of 300 grams of ore and 360 grams of process water. When no additive was used:

- bitumen extraction efficiency was measured at 92.3%;
- recovered froth was composed of 21.6% bitumen, 34.1% water and 45.4% solids; and
- the chemistry of the release water was: pH=8.33, Total Alkalinity (mg $CaCO_3$/L)=230, $HCO_3$ Alkalinity (mg $CaCO_3$/L)=230, $Na^+$=340 mg/L, $Mg^{2+}$=9.1 mg/L, $Ca^{2+}$=8.4 mg/L, CT=165 mg/L, and $SO_4^{2-}$=174 mg/L.

Extraction tests were performed on the same ore-water slurry sample, using the same process water and at the same temperature, and using CaO as a process aid for extraction at a dosage of 60 mg of CaO per kg ore, with the following results:

- bitumen extraction efficiency was measured as 96.4%;
- recovered froth was composed of 21.5% bitumen, 35.0% water, and 41.7% solids; and
- the chemistry of the release water was of pH=8.52, Total Alkalinity (mg $CaCO_3$/L)=247, $HCO_3$ Alkalinity (mg $CaCO_3$/L)=241, $Na^+$=338 mg/L, $Mg^{2+}$=10.4 mg/L, $Ca^{2+}$=10.2 mg/L, $Cl^-$=176 mg/L, and $SO_4^{2-}$=185 mg/L.

Similar results were obtained when the release water recovered from the previous extraction test (i.e., the extraction test performed with CaO addition) was used as the process water for the next extraction test. Extraction tests performed by recycling the release water more than five times by addition of CaO at dosages of 60 to 150 mg/kg ore at each cycle, indicated that bitumen extraction efficiency would be steady (or slightly increased) without deleteriously affecting the release water chemistry. The release water chemistry in each cycle showed that $Ca^{2+}$ and $Mg^{2+}$ concentrations were at or under 10 mg/L, and $Na^+$ concentration showed no significant increase; in some cases $Na^+$ concentration decreased (probably due to adsorption of $Na^+$ ions on newly-formed $Ca(CO)_3$ crystal surfaces resulting from the addition of $Ca(OH)_2$).

To assess the long-term effects of the use of CaO as an extraction process aid, extraction tests were performed by recycling (i.e., by re-using) the release water five times; in each cycle extraction test was performed by addition of CaO at a dosage of 150 mg/kg ore. These tests were carried out so as to produce sufficient release water to perform another extraction test by recycling the release water. Characteristics of the oil sands ore used in the tests are presented in FIG. 1. Properties of the release water after using CaO (at a dosage of 150 mg/kg ore per cycle) are presented in FIG. 2.

Extraction tests were performed using the release water samples recovered from each cycle. Three extraction tests were performed using the release water from each cycle: one test without any additive (i.e., base line or raw test), and two identical extraction tests using CaO at 60 mg/kg dosages. All extraction tests were performed using a Denver D-12 flotation cell, at 50° C. temperature. For each test, bitumen extraction efficiency and release water chemistry recovered from each test were determined. Bitumen extraction and release water chemistry data for the five recycle tests are presented in FIG. 3 and FIG. 4 respectively.

The data presented in FIG. 3 and FIG. 4 indicate that the release water recovered from extraction tests in each cycle is acceptable for recycling to the extraction process. The use of CaO at as process aid at a dosage of 150 mg/kg improves the efficiency of extraction process and improves the release water chemistry. The data presented in FIG. 3 and FIG. 4 indicate that CaO can be used to beneficial effect as an extraction process aid as an alternative to caustic NaOH.

The test data illustrate that bitumen extraction efficiency can be improved by the use of CaO lime (or $Ca(OH)_2$) as a process aid, without deleteriously affecting the release water chemistry. When CaO is used as a process aid for bitumen extraction, the chemistry of the release water improves; the release water becomes more suitable than the original water for recycling and re-use in the extraction process.

In summary, the addition of CaO (or $Ca(OH)_2$) into oil sands ore-water slurry systems as a process aid for bitumen extraction at low dosages (i.e., preferably at 50 to 150 mg/kg of ore, depending on the release water chemistry and clay content of the ore) can result in the following benefits:

- increased bitumen extraction efficiency (due to suppression of bitumen-clay attractions and promotion of bitumen-air attachments);
- Promotion of flocculation of clay particles, thereby reducing the amount of suspended clay particles in the release water, which would help reduce the concentration of clay-size particles in thickened cyclone overflow tailings (in cases where thickeners are used for thickening of cyclone overflow tailings as part of the tailings disposal practice);
- Improved release water chemistry due to reduction of $Ca^{2+}$ and $Mg^{2+}$ concentrations, thus making the release water suitable for being recycled to the extraction process without any water treatment; and
- Production of tailings with potentially more desirable geotechnical properties (e.g., better settling, consolidation, and non-segregation characteristics).

The dosage of CaO lime addition to oil sands ore-water slurry has to be controlled, since the excessive addition of CaO could result in flocculation of clay with $Ca^{2+}$, which would result in increased viscosity and the formation of yield stress. As persons skilled in the art will know, yield stress is a geotechnical property of the ore-water slurry, and is a measure of the shear stress when the shear rate is approaching zero. Formation of yield stress results in the ore-water slurry taking on a gel-like fluid property, caused by the clay flocculation by $Ca^{2+}$ (and/or $Mg^{2+}$) ions. Formation of yield stress in oil sands ore-water slurry is undesirable for bitumen extraction (whereas formation of yield stress is desirable for production of non-segregating tailings for the deposition of oil sands tailings as a non-segregating mix). Formation of yield stress can be anticipated for the addition of CaO in dosages of approximately 1,000 mg of CaO per kg ore or higher.

Experiments performed for the present invention suggest that the optimal upper limit of the CaO dosage is in the range of 600 mg per kg of ore, based on oil sands ore having the typical composition set out previously in this specification. The CaO dosage could be higher than 600 mg per kg depending on the ore composition (or, more specifically, the percentage of bitumen by weight), without deleteriously affecting the release water chemistry. However, the bitumen extraction efficiency would not be sharply reduced if CaO were to be used in excessive amounts.

The practical or desirable upper limit of CaO dosage will also be a function of process water chemistry and ore characteristics (e.g., bitumen properties, mineral type, fines contents, clay type, etc.). Therefore, CaO can be used as a bitumen extraction process aid within a broad range of CaO dosages, without deleteriously affecting bitumen extraction efficiency or release water chemistry. However, tests results have tended to suggest an optimal dosage of CaO lime addition in the range of 30 to 200 mg per kg of ore, and it is to be noted that the lime dosage can be effectively monitored by pH measurement. Although dosages outside this optimal range may be beneficially used in accordance with the principles of the present invention, the dosage of CaO lime addition preferably should not exceed the dosage that would increase the pH of the ore-water slurry to approximately 8.5 or higher.

Use of the methods of the present invention will prevent or minimize the undesirable accumulation of $Na^+$ ions in recycled release water from oil sands tailings (i.e., tailings water recycled for use in ore-water slurry), since these methods do not use any process additives such as NaOH or $Na_2CO_3$ or any other sodium salts (i.e., sodium salts of weak acids) for the extraction of bitumen.

The methods of the present invention may also result in significant reduction in the operating temperature of the oil sands ore-water slurry-based extraction processes (depending on the ore grade), thereby reducing thermal energy consumption, $CO_2$ emissions, and bitumen production costs.

The methods of the present invention may also be readily adapted for use in conjunction with processes taught in International Application No. PCT/CA2005/001875 (WIPO Pub. No. WO 2006/060917); i.e., the present invention could be used in conjunction with the addition of ozone ($O_3$) into ore-water slurry to oxidize bitumen asphaltenes to surfactant species, thus further promoting and enhancing bitumen extraction efficiency. The performance of ozone as an oxidant improves when the ore-water slurry is treated with CaO. The application of the teachings of both inventions, either concurrently or sequentially, will further promote the liberation of bitumen from the oil sands matrix by promoting the attachment of air bubbles to bitumen droplets, thereby forming a bitumen-rich froth which will float to the surface of the ore-water slurry, thus facilitating bitumen recovery.

The benefits and particulars of the methods of the present invention are further described and summarized below:

1. Addition or CaO lime (or $Ca(OH)_2$) to oil sands ore-water slurries in concentrations as low as approximately 50 milligrams of CaO per kilogram of ore improves the efficiency of bitumen extraction in water-slurry-based extraction processes by reducing promoting the liberation of bitumen from oil sands matrix and attachment of air bubbles to bitumen.
2. The addition and mixing of CaO (or $Ca(OH)_2$) into an oil sands ore-water slurry can be effected in a variety of ways, including direct introduction into ore conditioning vessels; ore-water slurry transportation pipelines; primary, secondary, or other separation vessels; and/or into slurry preparation feed water, including recycled release water and/or make-up water. Persons skilled in the art of the present invention will readily appreciate that other methods and means for adding and mixing CaO (or $Ca(OH)_2$) into an oil sands ore-water slurry may be devised without departing from the essential principles of the present invention.
3. The addition of CaO lime (or $Ca(OH)_2$) to oil sands ore-water slurries improves the efficiency of slurry-based bitumen extraction processes by reducing the attachment of clay particles to bitumen, thus promoting liberation of bitumen droplets from the oil sands matrix.
4. The addition of CaO lime (or $Ca(OH)_2$) o oil sands ore-water slurries, promotes and enhances the attachment of air bubbles to bitumen, thus promoting the flotation of bitumen to the slurry surface in the form of a bitumen-rich froth.
5. The addition of CaO lime (or $Ca(OH)_2$) to oil sands ore-water slurries improves bitumen extraction efficiency in the process temperature range of 25° C. to 85° C. Therefore, the methods of the present invention may enable or facilitate the reduction of extraction process temperatures to the preferable range of 35° C. to 45° C., resulting in significant savings in energy consumption and $CO_2$ emissions.

6. The addition of CaO lime (or $Ca(OH)_2$) to oil sands ore-water slurries reduces the amount of clay particles in the release water, by flocculating the clay particles by ion exchange mechanisms between the clay and $Ca^{2+}$ and $Mg^{2+}$ ions. As a result, addition of CaO as an extraction process aid promotes flocculation of clay particles, thereby reducing the amount of suspended clay particles in the release water, and helping to reduce the concentration of clay-size particles in thickened cyclone overflow tailings.
7. The addition of CaO lime (or $Ca(OH)_2$) to oil sands ore-water slurries improves the water chemistry of the release water by reducing $Ca^{2+}$ and $Mg^{2+}$ concentrations, by way of bicarbonate-to-carbonate reactions and by ion exchange reactions between the clay particles and $Ca^{2+}$ and $Mg^{2+}$ ions.
8. The methods of the present invention reduce or eliminate the accumulation of $Na^+$ ions in recycled release water from oil sands tailings, since the present methods not use process aids such as NaOH, $Na_2CO_3$, or any other sodium salts of weak acids for the extraction of bitumen.
9. The $Ca^{2+}$ ions introduced into the ore-water slurry by virtue of CaO lime (or $Ca(OH)_2$) addition in accordance with the present invention also promotes flocculation of clay particles during the disposal of oil sands tailings.
10. Carbon dioxide ($CO_2$) contained in the atmosphere will also react with $Ca(OH)_2$ lime added into ore-water slurry and thus enhance the precipitation of calcium carbonate, with consequent reduction of the pH of the slurry and/or release wafer to as low as or lower than 8.0.
11. The methods of the present invention can be readily adapted for cooperative use in association with other processes directed to bitumen recovery from oil sands ore, including but not limited to the processes taught by the following patent applications:

International Application No. PCT/CA2005/001875 (WO 2006/060917) (directed to the use of ozone ($O_3$) to oxidize and thus convert bitumen asphaltenes to surfactant species which improve die efficiency of bitumen extraction); and Canadian Patent No. 2,188,064 and Canadian Patent Application No. 2,522,031 (directed to the production of non-segregating oil sands tailings using CaO or CaO+ $CO_2$).

It is commonly assumed and accepted by the oil sands industry that the presence of $Ca^{2+}$ and $Mg^{2+}$ ions in ore-water slurry has a detrimental effect on the efficiency of bitumen extraction in ore-water slurry based extraction processes. It has been experimentally shown that $Ca^{2+}$ and $Mg^{2+}$ ions bond clay particles to bitumen droplets, since both bitumen droplets and clay particles in ore-water slurry are negatively charged; as a result, bitumen/air-bubble attractions and bitumen froth formation—and, therefore, bitumen extraction efficiency—are suppressed. The methods of the present invention use CaO (lime), or $Ca(OH)_2$ when dissolved in water; therefore, the present innovation introduces $Ca^{2+}$ ions, into the ore-water slurry along with OH ions.

The introduction of $Ca^{2+}$ ions as a process aid to promote bitumen extraction efficiency, as taught by the present invention, contradicts the conventional wisdom regarding the purportedly detrimental effect of $Ca^{2+}$ ions with respect to bitumen extraction efficiency. The present invention, however, uses CaO at low dosages, sufficient to increase pH to about 8.5 to 9.0 by the OH ions introduced by the addition of CaO, as in the case of conventional extraction processes which use caustic NaOH (e.g., Clark's Hot Water Extraction or CHWE process). When CaO is used at dosages in accordance with the methods of the present invention, $Ca^{2+}$ ions introduced to ore-water slurry react with the clay particles by ion-exchange mechanism (reaction), which results in the flocculation of clay particles. Flocculation of clay particles offers additional advantage for the ore-water slurry based extraction process by reducing the clay size particles in the release water.

Although the methods of the present invention have been described with specific reference to the use of CaO lime (or $Ca(OH)_2$) as a process additive, it is also to be noted that the methods of the invention can be readily adapted to use oxides (or hydroxides) of other alkaline earth metals (for example, beryllium, magnesium, strontium, and barium) as alternatives to CaO lime (or $Ca(OH)_2$), and all such alternative methods and usages are intended to come within the scope of the present invention.

It will be readily appreciated by those skilled in the art that various modifications of the present invention may be devised without departing from the essential concepts and principles of the invention, and all such modifications are intended to come within the scope of the present invention and the claims appended hereto. It is to be especially understood that the invention is not intended to be limited to illustrated embodiments, and that the substitution of a variant of a claimed element or feature, without any substantial resultant change in the working of the invention, will not constitute a departure from the scope of the invention.

In this patent document, the word "comprising" is used in its non-limiting sense to mean that items following that word are included, but items not specifically mentioned are not excluded. A reference to an element by the indefinite article "a" does not exclude the possibility that more than one of the element is present, unless the context clearly requires that there be one and only one such element.

What is claimed is:

1. A method for enhancing the efficiency of bitumen recovery from oil sands ore, said method comprising the step of mixing lime into an oil sands ore-water slurry in association with a slurry-based bitumen extraction process, wherein:

(a) the lime is introduced into the ore-water slurry in a chemical form selected from the group consisting of calcium oxide (CaO) and calcium hydroxide ($Ca(OH)_2$);

(b) the lime dosage is selected to maintain the pH of the ore-water slurry at a value between approximately 8.0 and approximately 9.0; and (c) the process temperature of the slurry-based bitumen extraction process during the step of mixing lime into the ore-water slurry is maintained between 35 degrees Celsius and 45 degrees Celsius.

2. The method of claim 1 wherein the lime dosage is from approximately 30 to approximately 600 milligrams per kilogram of oil sands ore.

3. The method of claim 1 wherein the lime dosage is from approximately 30 to approximately 200 milligrams per kilogram of oil sands ore.

4. The method of claim 1 wherein the lime dosage is from approximately 60 to approximately 150 milligrams per kilogram of oil sands ore.

5. The method of claim 1 wherein the mixing of lime into the oil sands ore-water slurry is effected by introducing the lime into the slurry feed water.

6. The method of claim 5 wherein the slurry feed water is recycled release water.

7. The method of claim 1 wherein the mixing of lime into the oil sands ore-water slurry is effected by introducing the lime into an ore conditioning vessel.

8. The method of claim 1 wherein the mixing of lime into the oil sands ore-water slurry is effected by introducing the lime into a slurry transportation pipeline.

9. The method of claim 1 wherein the mixing of lime into the oil sands ore-water slurry is effected by introducing the lime into a separation vessel.

10. The method of claim 1, comprising the additional step of introducing ozone ($O_3$) into ore-water slurry.

11. A method for enhancing the efficiency of bitumen recovery from oil sands ore, said method comprising the step of mixing an oxide of an alkaline earth metal into an oil sands ore-water slurry in association with a slurry-based bitumen extraction process, wherein the alkaline earth metal is selected from the group consisting of beryllium, strontium, and barium.

12. A method for enhancing the efficiency of bitumen recovery from oil sands ore, said method comprising the step of mixing a hydroxide of an alkaline earth metal into an oil sands ore-water slurry in association with a slurry-based bitumen extraction process, wherein the alkaline earth metal is selected from the group consisting of beryllium, strontium, and barium.

* * * * *